US011306986B1

(12) United States Patent
Titus et al.

(10) Patent No.: US 11,306,986 B1
(45) Date of Patent: Apr. 19, 2022

(54) TRANSFORMER SUB-PISTOL FIREARM

(71) Applicants: Lemoy Titus, Randolph, MA (US); Patrick Stanley, York Town (JM)

(72) Inventors: Lemoy Titus, Randolph, MA (US); Patrick Stanley, York Town (JM)

( * ) Notice: Subject to any disclaimer, the term of this patent is extended or adjusted under 35 U.S.C. 154(b) by 0 days.

(21) Appl. No.: 17/181,664

(22) Filed: Feb. 22, 2021

(51) Int. Cl.

| | |
|---|---|
| ***F41A 3/66*** | (2006.01) |
| ***F41A 11/04*** | (2006.01) |
| ***F41A 9/37*** | (2006.01) |
| ***F41A 19/32*** | (2006.01) |
| ***F41A 19/35*** | (2006.01) |

(52) U.S. Cl.
CPC ..... *F41A 11/04* (2013.01); *F41A 3/66* (2013.01); *F41A 9/37* (2013.01); *F41A 19/32* (2013.01); *F41A 19/35* (2013.01)

(58) Field of Classification Search
CPC ..... F41A 11/02; F41A 9/37; F41A 3/66
USPC ..... 89/128, 1.41
See application file for complete search history.

(56) References Cited

U.S. PATENT DOCUMENTS

| | | | | |
|---|---|---|---|---|
| 1,784,355 | A | 12/1930 | Herlach | |
| 2,483,837 | A | 10/1949 | Nettles | |
| 3,043,198 | A | 7/1962 | Darsie | |
| 3,314,182 | A | 4/1967 | Harvey | |
| 3,355,988 | A | 12/1967 | D'Andrea | |
| 3,411,407 | A | 11/1968 | Pachmayr | |
| 3,736,839 | A | 6/1973 | Childers | |
| 4,069,740 | A | 1/1978 | Hottinger | |
| 4,833,969 | A | 5/1989 | Winkler | |
| 11,193,724 | B1 * | 12/2021 | McCarthy | F41C 23/04 |
| 2007/0151438 | A1 | 7/2007 | Courty | |
| 2011/0030258 | A1 * | 2/2011 | Fistikchi | F41C 23/22 42/1.06 |
| 2018/0224239 | A1 * | 8/2018 | Noonan | F41C 23/22 |
| 2018/0283819 | A1 | 10/2018 | Bandini | |

FOREIGN PATENT DOCUMENTS

| | | |
|---|---|---|
| DE | 102012109701 B4 | 7/2014 |
| WO | 2009025889 | 2/2009 |

* cited by examiner

*Primary Examiner* — Reginald S Tillman, Jr.
(74) *Attorney, Agent, or Firm* — Lambert Shorten & Connaughton; David J. Connaughton, Jr.; Justin P. Tinger

(57) ABSTRACT

A firearm is disclosed which advantageously allows for firing from two different magazines, one in a magazine well ahead of a trigger, and a second magazine held in a handle of a pistol grip of the firearm. This allows for both sub-machine gun and pistol firing configurations, allowing for increased firing capacity and allowing the firearm to continuously fire while reloading.

20 Claims, 13 Drawing Sheets

8C 8B
8C
8A
8C
8
8F 8D
44F
44C
44A
44B 25
33

33
35
8D 26
3A
5

3B
26A
9G
26

3C
25
25

6
6A
6B
26A
9F
9B
27D 44F
37
25

24
24
23A
23A
38B
2
37D
12A
22F
13F
13
22
21C
22D
22H
37E
38C
22F
22C
1
21
37E
21A 38A
22B
37
22A 15A
14
17A
17C

TRANSFORMER SUB-PISTOL FIREARM

FIELD OF DISCLOSURE

The present disclosure relates to firearms, and more specifically to modified submachine guns. A modified submachine gun is provided that holds a cartridge in front of the trigger ring in a traditional submachine gun position and holds and additional cartridge in the grip of the gun, behind the trigger ring. The disclosed firearm is able to fire from a submachine gun position and from a pistol position, advantageously allowing a user to hold more ammunition in the weapon and continuously fire while reloading either of the weapon's cartridges.

BACKGROUND

Submachine guns (SMGs) were developed in World War I as a smaller alternative to larger machine guns, which made them more portable and maneuverable in trench warfare. SMGs are thus characterized by their smaller size, most notably in their shorter barrel as compared to, for example, machine guns of World War I era and modern assault rifles. SMGs are referred to as carbines, i.e., long gun firearms having shorter barrels. Long guns are defined as firearms designed to be held by both hands and braced against the shoulder during fire in contrast to a handguns/pistols which can be fired when held in one hand.

While SMGs have evolved since their introduction in the early 1900s, their general structure and operation remains the same. Submachine guns (SMGs) are magazine-fed firearms capable of both semi-automatic and automatic firing. Rounds in SMGs are fired from a single magazine positioned in front of the trigger ring. SMGs are designed to shoot pistol magazines. Pistol magazines are magazines traditionally used with handguns are thus fire smaller caliber bullets than, for example, assault rifles. Pistols typically fire these smaller projectiles at lower velocities than assault and other larger rifles. For these reasons, SMGs are often used by military special forces and police SWAT teams in close quarter combat because SMGs, in contrast to assault and larger rifles, are easier to control due to their smaller size and calibers are less likely to over-penetrate intended targets.

The long gun construction of SMGs paired with the fact that SMGs fire pistol cartridges presents a unique opportunity to introduce more ammunition and firing power into the weapon. The grip of SMGs located behind the trigger ring resembles the construction of traditional handguns. This grip could be used to hold a second magazine. However, reloading an SMG magazine with a second magazine without being able to continue fire, regardless of where it is held, wastes essential time. Thus, there exists a need for a modified SMG than can transition from SMG mode to pistol mode and fire from a magazine stored in the grip of the SMG. This configuration would advantageously allow reloading of the SMG cartridge while firing from the grip cartridge, thus enabling reload without having to cease fire.

SUMMARY OF INVENTION

The subject matter of this application may involve, in some cases, interrelated products, alternative solutions to a particular problem, and/or a plurality of different uses of a single system or article.

In one aspect, a firearm is provided. The firearm is formed of a lower receiver and an upper receiver which is connected to the lower receiver and slideably movable relative to the lower receiver. A magazine well is defined by the lower receiver and a first magazine is held therein. A pistol grip on the lower receiver defines an opening which houses a second magazine. The upper receiver is movable between a submachine gun firing mode having the upper receiver engaged with and capable of firing from the first magazine, to a pistol mode having the upper receiver engaged with and capable of firing from the second magazine.

DETAILED DESCRIPTION

Figure 1:
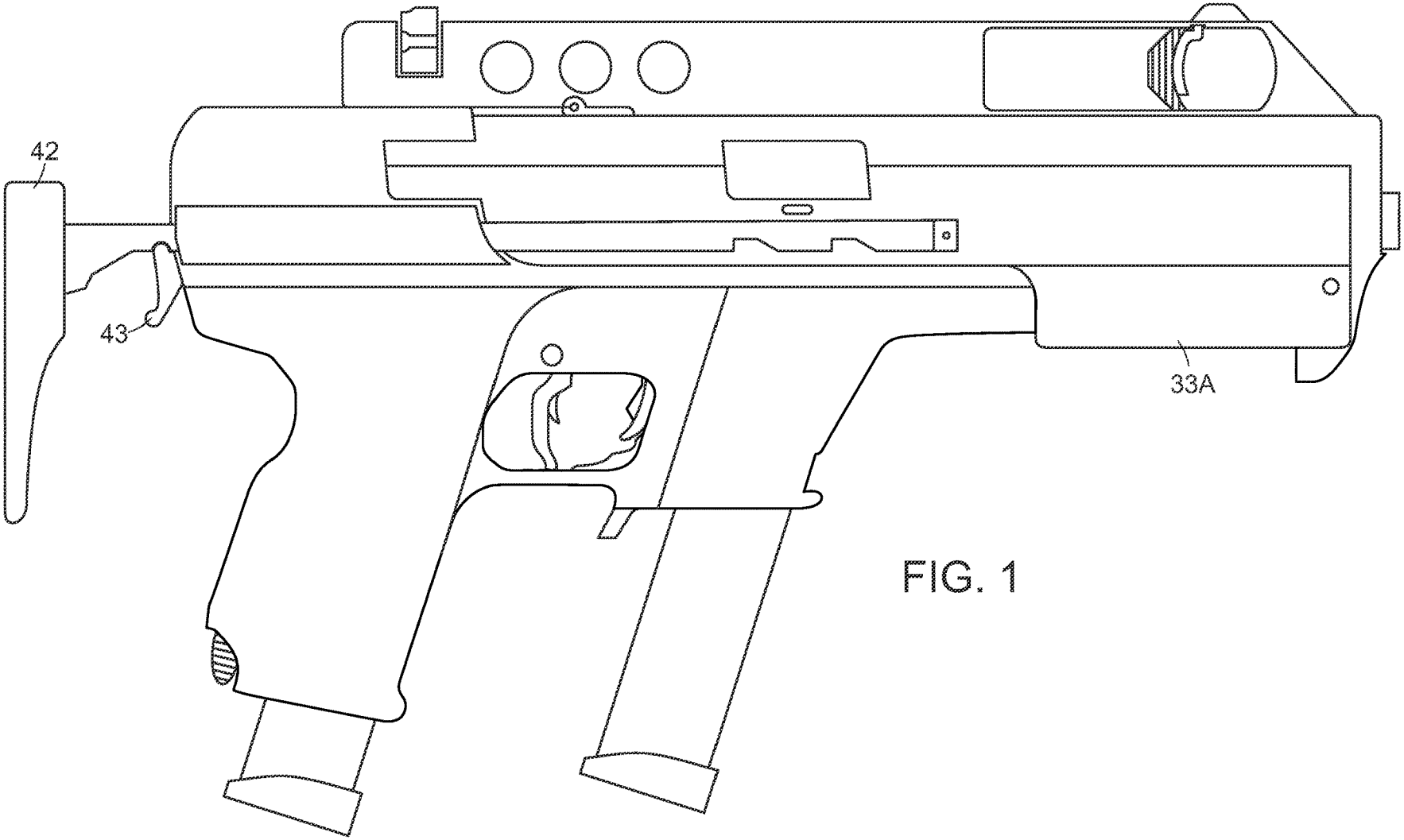
FIG. 1 provides an elevation view of an embodiment of the firearm disclosed herein.

The presently disclosed firearm advantageously makes use of the both sub-machine gun and pistol firing configurations to provide a carbine firearm that transforms from a submachine gun firing mode to a pistol firing mode, and is able to fire a projectile from a first magazine in a submachine gun configuration and is also able to fire a projectile from second magazine in a pistol configuration. The disclosed firearm is thus referred to herein as a "transformer sub-pistol." In some embodiments, the barrel of the disclosed transformer sub-pistol has a maximum length of 5.5 inches. In some embodiments, the total weapon length is a maximum of 13 inches. This compact size is advantageous for use in close combat.

The presently disclosed firearm makes use of many features standard to semi-automatic pistols and submachine guns, and thus, prior to discussing the mechanics of the transformer sub-pistol, a brief discussion of the manner in which a semiautomatic weapon is fired is first discussed herein.

The key components of semiautomatic firearms, including pistols and SMGs, that are responsible for the weapon's ability to fire are contained within the receiver. The receiver, as the name suggests, receives ammunition. The receiver houses the weapon's internal components, including the hammer, action, and firing mechanism. The receiver of semiautomatic pistols, for example, includes a frame having a set of rails. A slide is mounted on a set of rails and can freely move backwards and forwards along the frame. The barrel of the firearm, the portion of the weapon which receives and ejects a projectile, can be attached to the frame, in which case the slide is located to the rear of the barrel, or, in other designs, the barrel can be mounted within the slide. The slide further houses a firing pin/striker, depending on the weapon, and extractor. The firing pin is involved in the firing mechanism and the extractor discards used cartridges after they have been fired. The extractor dispenses spent cartridges from the chamber via an ejection port on the receiver. Semi-automatic pistols may utilize an external hammer, internal hammer, or a spring-loaded striker or firing pin.

When the semiautomatic weapon, e.g., a pistol, is first loaded by inserting a magazine containing cartridges into the magazine well, no cartridges enter the chamber and the weapon is not ready to fire. Cartridges are cases that contain a bullet, propellant, and an ignition device. It will be appreciated by those of skill in the art that a bullet refers to only the projectile that leaves the barrel of the firearm, and cartridges, also used interchangeably with rounds, are the pre-assembled ammunition loaded into magazines. Magazines used in semi-automatic weapons are unique in that they are spring-loaded. A tension spring applies pressure to the ammunition in the magazine in an upwards direction towards the barrel of the firearm. The pressure applied by the magazine spring slides the next available cartridge across the breech and into the chamber when the slide is pulled backward. The same pressure is applied to the next cartridge in the magazine when the gun is fired, thereby loading next cartridge into the chamber.

To load a round into the chamber, the slide must be appropriately engaged by being pulled back, allowing the ammunition in the spring-loaded magazine to enter the chamber, i.e., to be inserted into the firing position. When the trigger is pulled, the firing pin is struck by the hammer (or the striker pin is released, depending on the specific design of the weapon) which in turn strikes the primer cap on the cartridge. The primer ignites the propellant in the cartridge which then causes the rapid buildup of gas within a small volume. This rapid increase in pressure ultimately propels the bullet from the barrel of the gun at a high velocity. After the bullet has left the barrel, the released gasses from the propellant force the slide (and a breechblock) rearward, which in turn cocks the hammer for the next round. During this process, the ejector pin grabs the spent shell and ejects it via the ejection port. The magazine, via its internal spring, replaces the spent cartridge with a fresh round as the slide returns to its original resting position. The trigger is reset to the firing position, allowing the shooter to continue firing rounds.

There are three main types of semiautomatic pistols, blowback action pistols, recoil action pistols, and gas operation action pistols. Each type of action is designed to confine the high-pressure gasses from the propellant to certain parts of the firearm to both prevent damage to the firearm and ensure shooter safety by ensuring that the breech is not opened until pressure within the weapon has dropped to safe levels, which is accomplished by closing the breech for a certain amount of time during action.

Gas-operated actions pistols are used when the pressure in the chamber resulting from the ignition of a cartridge's propellant is high enough that the opening of the breech would occur too rapidly with simple or delayed blowback. In such weapons, the breechblock is "locked" into the barrel, referred to as a locked-breech design. In a locked-breech design, the slide contained the breechblock. At the point of firing, the inertia pushes the barrel and slide/breechblock backwards together for a certain distance. This type of action utilizes the combined weight of the slide/breech and barrel so that its inertia prevents movement from occurring too quickly, and this type of action, with respect to the breech, may be referred to as "floating action". The breech locking mechanism is designed to disengage after the slide/breech has traveled a certain distance, which ensures the pressure within the weapon has dropped to safe levels.

In accordance with aspects and embodiments, the transformer sub-pistol is a delayed blowback firearm. However, the disclosed transformer sub-pistol may be modified to operate via gas operated or recoil action, and such design modifications will be readily ascertained by those of skill in the art.

In accordance with aspects and embodiments, the disclosed transformer sub-pistol comprises an upper receiver 100 that travels horizontally along a lower receiver in between a first magazine positioned in a submachine gun firing configuration and second magazine positioned at the grip of a traditional SMG, and, positioned in a pistol firing configuration. The upper receiver includes an upper receiver housing and upper receiver. The upper receiver contains all the parts necessary to discharge at least one round manually loaded into the chamber. The upper receiver housing encloses the inner upper receiver and contains a single magazine port, which may alternatively be referred to herein as a magazine well, and a feed ramp. The upper inner receiver and the upper receiver housing are fixed to one another by a locking pin and further pinned to one another and the lower receiver by a pivot pin.

The lower receiver 200 contains both magazines, a trigger group (trigger assembly), and a trigger that is connected to the upper receiver via a detachable lever. The lower receiver is pinned to the upper receiver by a pivot pin and is held in place by a slide port. The slide port has an open top that allows the upper receiver to pass through the port and the configuration of the lower receiver facilitates smooth sliding from the first magazine to the second magazine and vice versa.

Most known submachine guns are fired from a single magazine positioned in front of the trigger ring, leaving the weapon with an empty pistol grip that could potentially use a second magazine that could be activated by a push of a knob. This would allow the user to carry more loaded ammunition without changing the overall shape of the weapon. In addition, the firearm may operate as a hybrid submachine gun that could theoretically be operated as a pistol, hence the term "Transformer Sub-Pistol". The advantage of this firearm is that a user can reload one magazine while still having access to a loaded magazine reserved to fire at the user's discretion.

Turning to the figures, the operation behind this invention is a mechanism that will allow a part known as an upper receiver to travel forward and backward or from magazine one 300 (SMG mode) to magazine two 400 (Pistol mode) on a part known as the lower receiver. The typical interchangeable transformer subpistol magazine is made up of a catch slot 37A and a ridge 37B which forms the catch slot and acts as a guide for both magazines. The weapon is designed with a conventional butt stock 42 which can be extended manually or automatically when the weapon moves from position on to two. Butt stock 42 is held in place by a catch 43 which can be released manually by the user or automatically when the weapon changes position. A finger guard 33 and hand guard 33A is designed to keep the user safe during operation. Finger guard 33 prevents the user from accidentally putting their support hand finger in front of the barrel and hand guard 33A protects the user's support hand when the weapon is moved between position one and two.

This weapon can be separated into three parts, the part known as the upper receiver can be divided into two section: outer upper receiver housing and inner upper receiver housing. The next portion is the lower receiver. Both upper and lower receiver are connected at the front of the weapon at 25A and held in place by the pivot pin 25. The inner upper receiver contains most of the major parts such as bolt, barrel, striker, recoil spring, ejector, extractor, sears, trigger operating rod and disconnectors. The outer upper receiver is made mainly to enclose the inner upper receiver and contains a single magazine opening 37 and a feed ramp 38A-C. Both inner upper receiver is pinned at pivot pin 25 after it is slid through upper receiver slide port 3D. The inner upper receiver is locked to the outer upper receiver at upper receiver lock pin 3B. The retainer plate 5 is used to hold the recoil rod 3 and recoil spring 4 in place while recoil spring stop ridge 3A is used to stop recoil spring 4 from touching the recoil and ejector rod retaining plate 5. Upper receiver lock pin 3B is depressed until it slides through receiver locking well 3C and this acts as a lock for the outer and inner upper receiver. The upper receiver contains all the moving parts and functions to conventionally allow discharge of at least one round if manually loaded in the chamber. The lower receiver contains both magazine and a trigger that is connected to the upper receiver via a detachable lever. It also has both magazine, trigger group, locking/release cylinder retract spring and guide rail. The lower receiver is pinned to the upper receiver at pivot pin 25 and is held in place at upper receiver slide port 3D. Upper receiver slide port 3D has an open top that allows the upper receiver to pass through as the top is open, however the sides are designed for holding the upper receiver and also allowing smooth sliding from one magazine to the next.

The weapon is designed with an ambidextrous charging angle 7 built into a detachable system which includes sights 1, 2, and picatinny rails 7A that is mounted on top of the inner upper receiver. Element 7 is a part of a detachable ambidextrous charging system 36 which can be removed from the upper receiver. Ambidextrous charging attachment 36 houses the charging angle 7 and the picatinny rail system 7A. Ambidextrous charging attachment 36 is slid under a dove tail style lock at dovetail groove 30 and is pinned at the charging angle housing pin 31. A groove is left in the inner receiver shown at the charging angle connection slot 35 to charging angle contact ridge 35A to engage bolt 6 when charging the weapon. The charging angle is activated by making contact with the charging angle locking system 29A which is a safety lock which prevents accidental charging, reciprocation of the bolt with the charging angle and can also use to lock the bold open for inspection. It is found in a finger ring looking area on ambidextrous charging attachment 36. When locking system 29A is activated the user is able to manually charge the weapon using a finger. Disconnector contact point 29A is kept in place by a spring 29B which keeps locking trigger 29A in the correct position at all time. When the weapon is being charged or during the bolt cycle after the weapon is discharged, the barrel 8 is held inside the upper receiver at barrel delay locking groove 8D by barrel camel dowel 8C. The bolt 6 and barrel 8 are designed to cycle backwards but are prohibited to do for a small amount of time due to a delayed locking system which holds the bolt 6 and barrel 6 together until the bullet exits the chamber, thus resulting in a drop in pressure. After the pressure drops, the barrel 8 and bolt 6 travel backwards for about 1 cm before the barrel falls somewhat vertically downwards due to the barrel camel dowel 8C which allows the barrel feed ramp 8F to make contact with upper receiver feed ramp 38 to feed a round in the chamber when bolt 6 cycles forward. The bolt 6 continues its cycle backwards, compressing the recoil spring 4 which forces the bolt 6 forward at the end of the backwards cycle. In returning, the bolt 6 pushes the barrel 8 back in place and holds it there until the bolt 6 cycles again and loads a round into the chamber. For stability, barrel 8 is depressed at the barrel front delay lock 8A and 8B to match the bolt charging slot 6A and bolt catch point 6B. This design significantly aids in the balance of the weapon when an add-on is used. Ejector rod 26 and extractor 26A are used to remove the shell casing from the chamber when the breech opens at ejection port 32.

FIG. 1 displays the weapon in its normal firing position when magazine one is activated. As shown in the figures, the function is feasible via receiver locking/release cylinder 22. Receiver locking/release cylinder 22 locks the upper receiver to the lower receiver in position one (to fire magazine one—i.e. the SMG mode) via receiver locking slot one 22A. Upper receiver magazine well 37 is now directly in line with lower receiver magazine well one 37D. Magazine one is now forced upwards into its feeding position. The upper receiver see saw lever 21 is positioned such that see saw rod 21D now rests directly on see saw rod suppression face 21F forcing it downwards while lifting the opposite end. The see saw lever 21 is pinned in the center at pivot point pin 21C which allows it to operate like a see saw when a force is applied. This movement forces magazine one operating block 12 upwards because it is pinned to the see saw lever 21 at connection 12A. At magazine one catch 12D the magazine is also forced upwards into the upper receiver magazine well 37 because each magazine sits in a magazine catch slot at 37A. The upward movement caused by see saw lever 21 then transfers to magazine one operating block 12 which is reciprocated by magazine one catch 12D which pulls the magazine upwards into position for firing. Magazine one operating block 12 sits in a guide way 12C via magazine operating bar guide rail 12G. This allows the magazine one operating block 12 to move up and down to activate the magazine or decommission the magazine. When magazine one is in firing mode spring 19B is in compression. The magazine can be released by pressing magazine one release button 12B. The magazine catch lever 12H is pinned at catch pin 12F. A magazine catch spring 12E is responsible for keeping the magazine one catch 12D in magazine catch slot 37A when the magazine is in the well.

Figure 2:
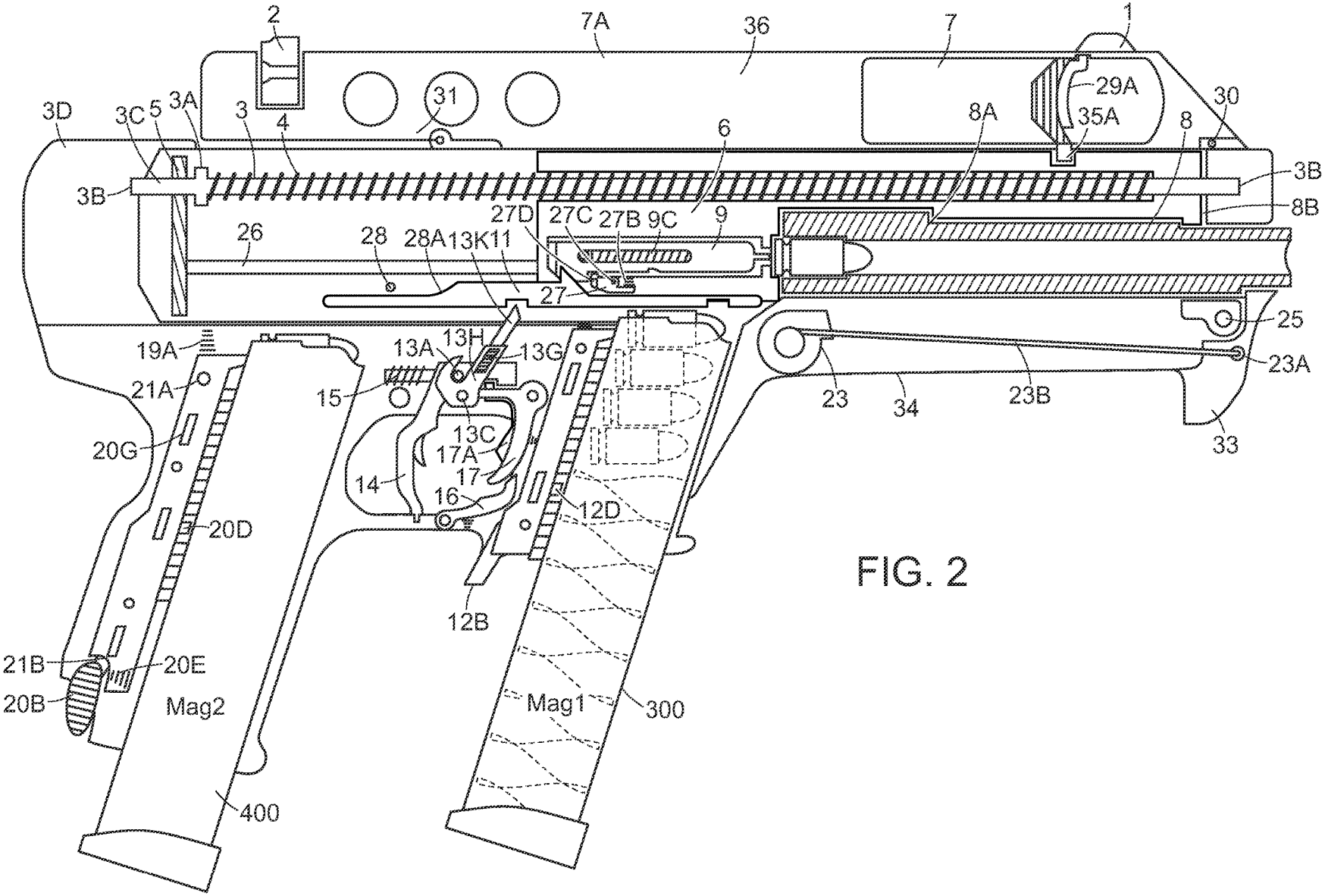
FIG. 2 provides a cutaway view of an embodiment of the firearm in a submachine gun mode.
Figure 3:
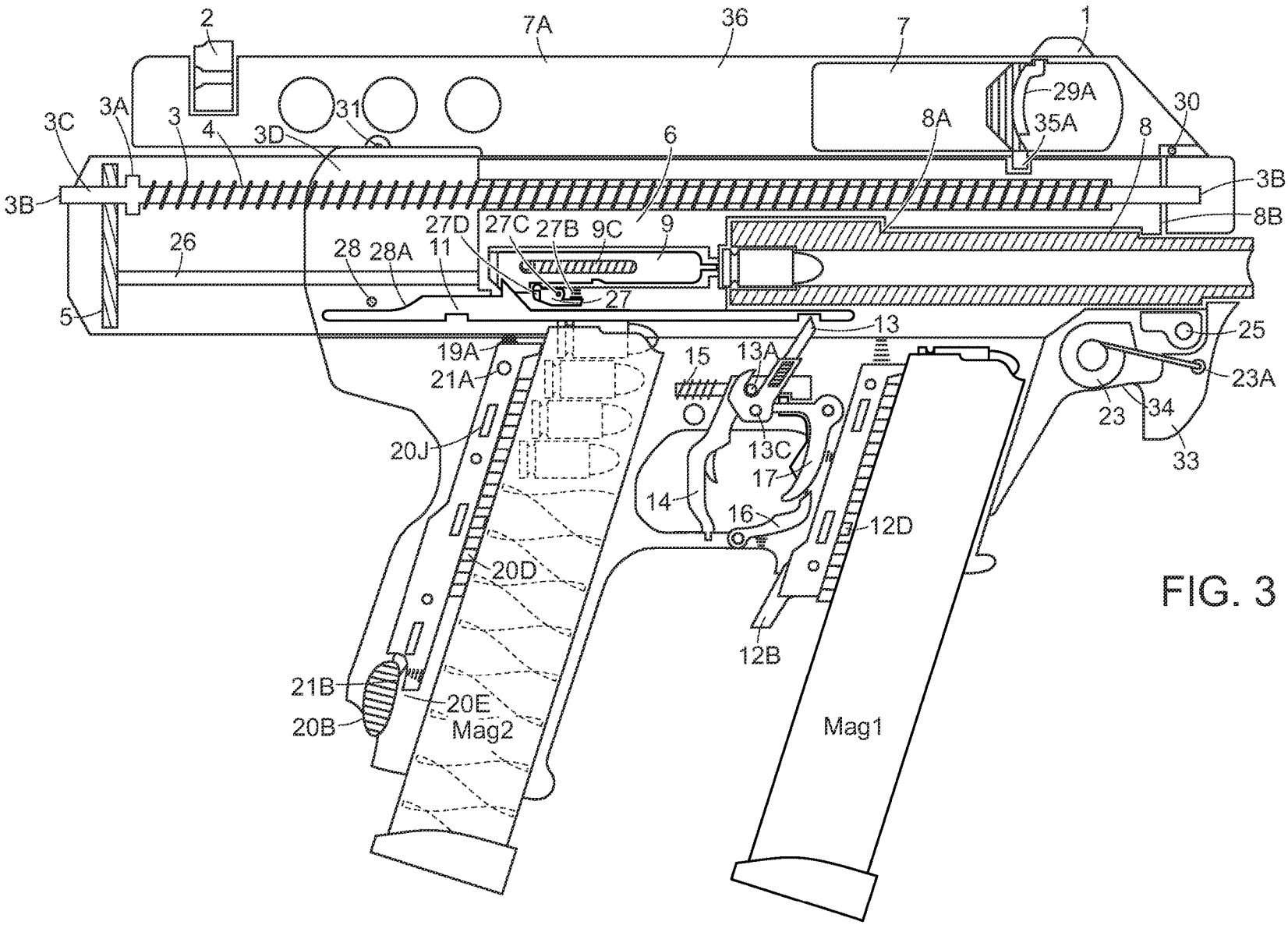
FIG. 3 provides a cutaway view of an embodiment of the firearm in a pistol mode.
Figure 4A:
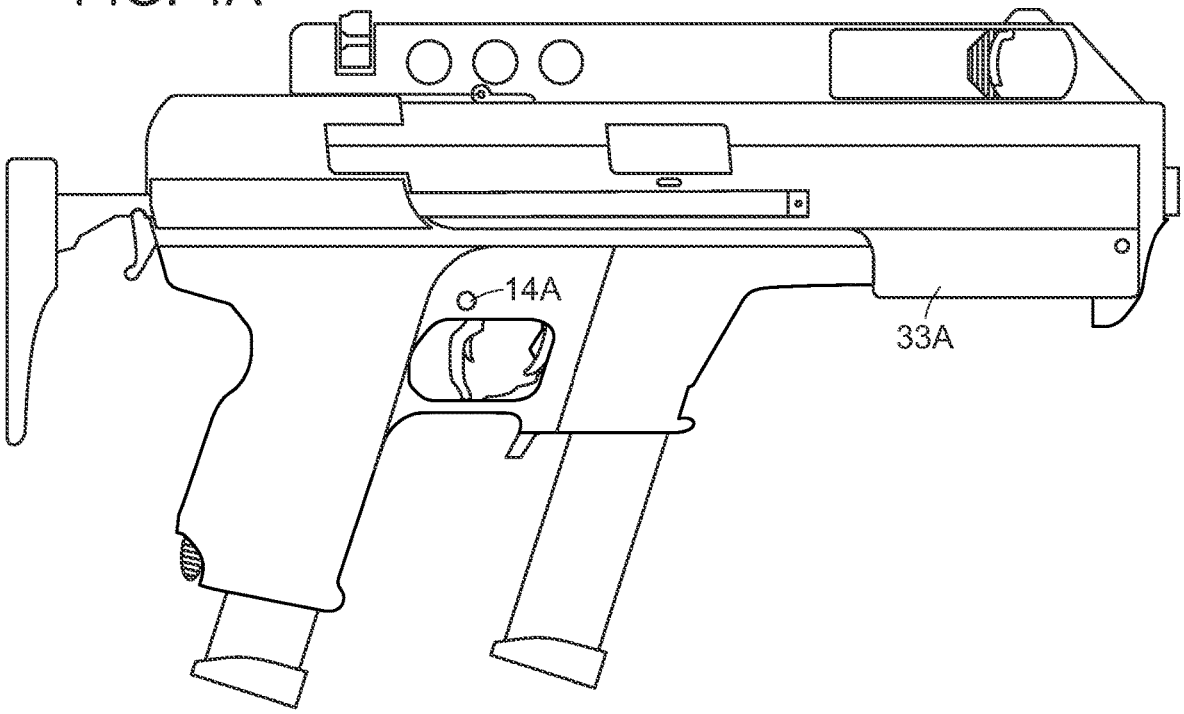
FIG. 4A provides an elevation view of an embodiment of the firearm in a submachine gun mode.
Figure 4B:
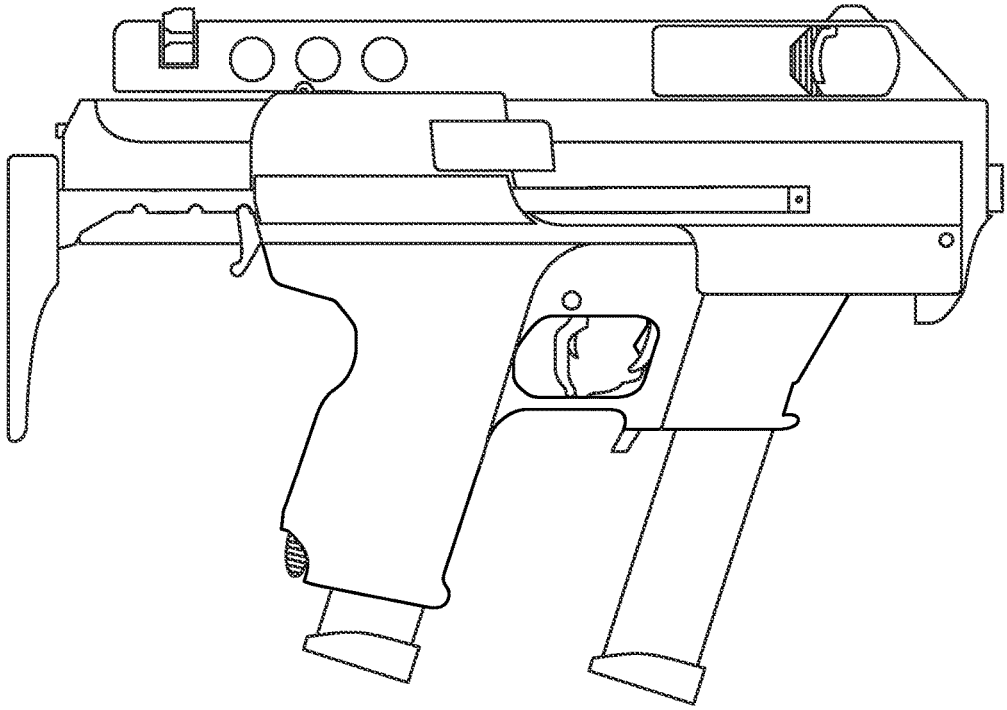
FIG. 4B provides an elevation view of an embodiment of the firearm in a pistol mode.
Figure 5A:
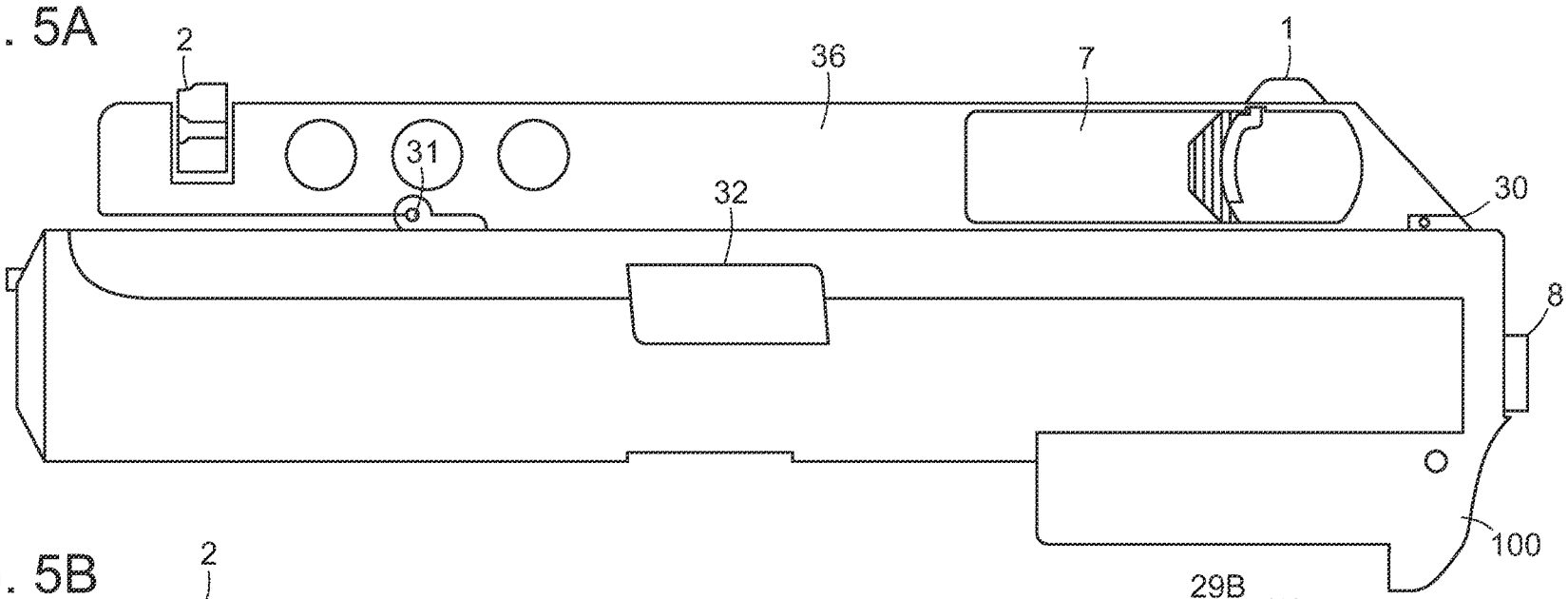
FIG. 5A provides an elevation view of an embodiment of an upper receiver of the firearm.
Figure 5B:
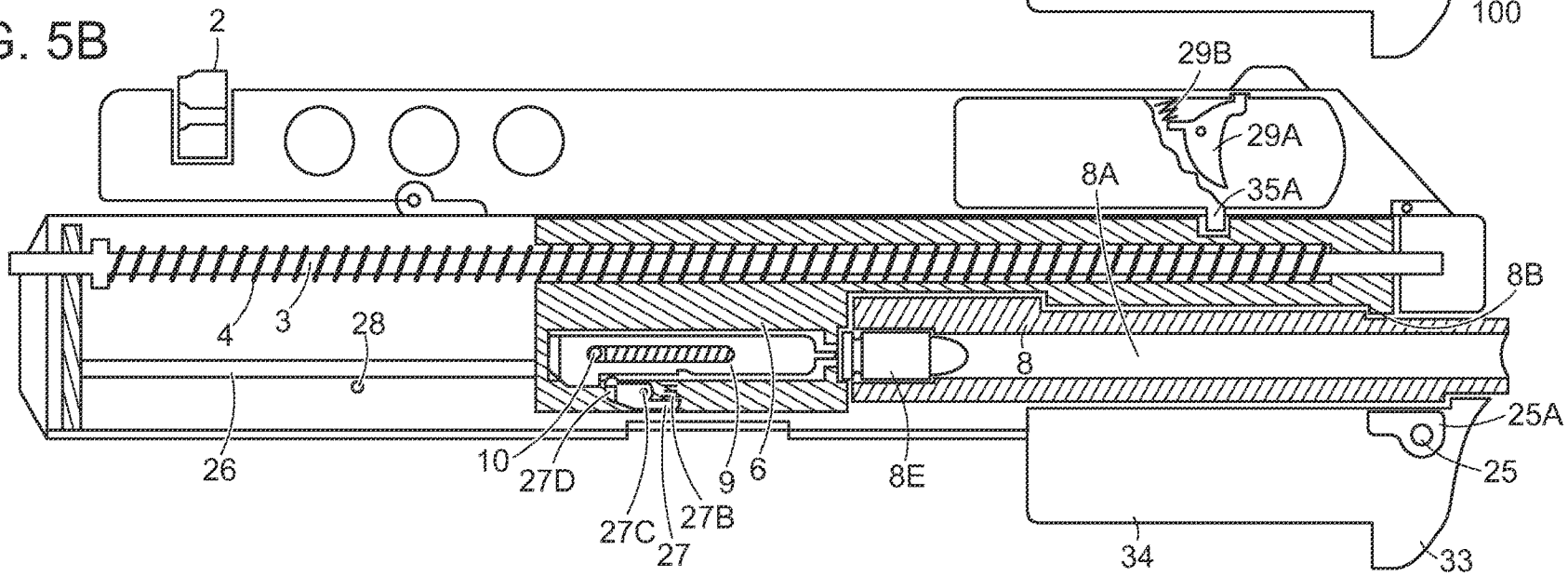
FIG. 5B provides a cutaway view of an embodiment of an upper receiver of the firearm.
Figure 5C:
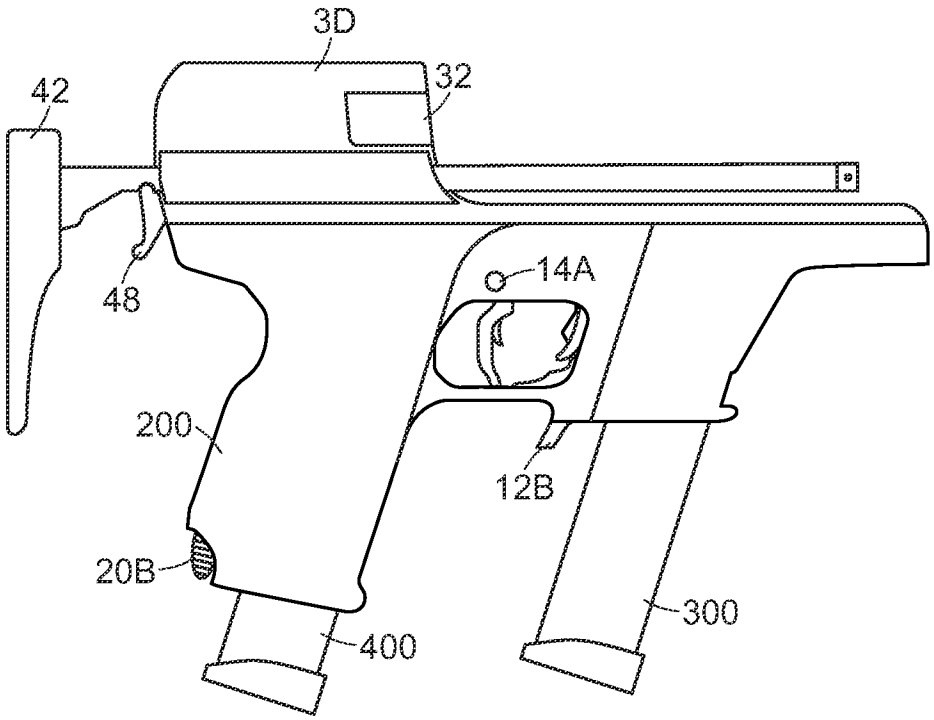
FIG. 5C provides an elevation view of an embodiment of a lower receiver of the firearm.
Figures 6A, 6B, 6C, 6D, 6E, 6F:
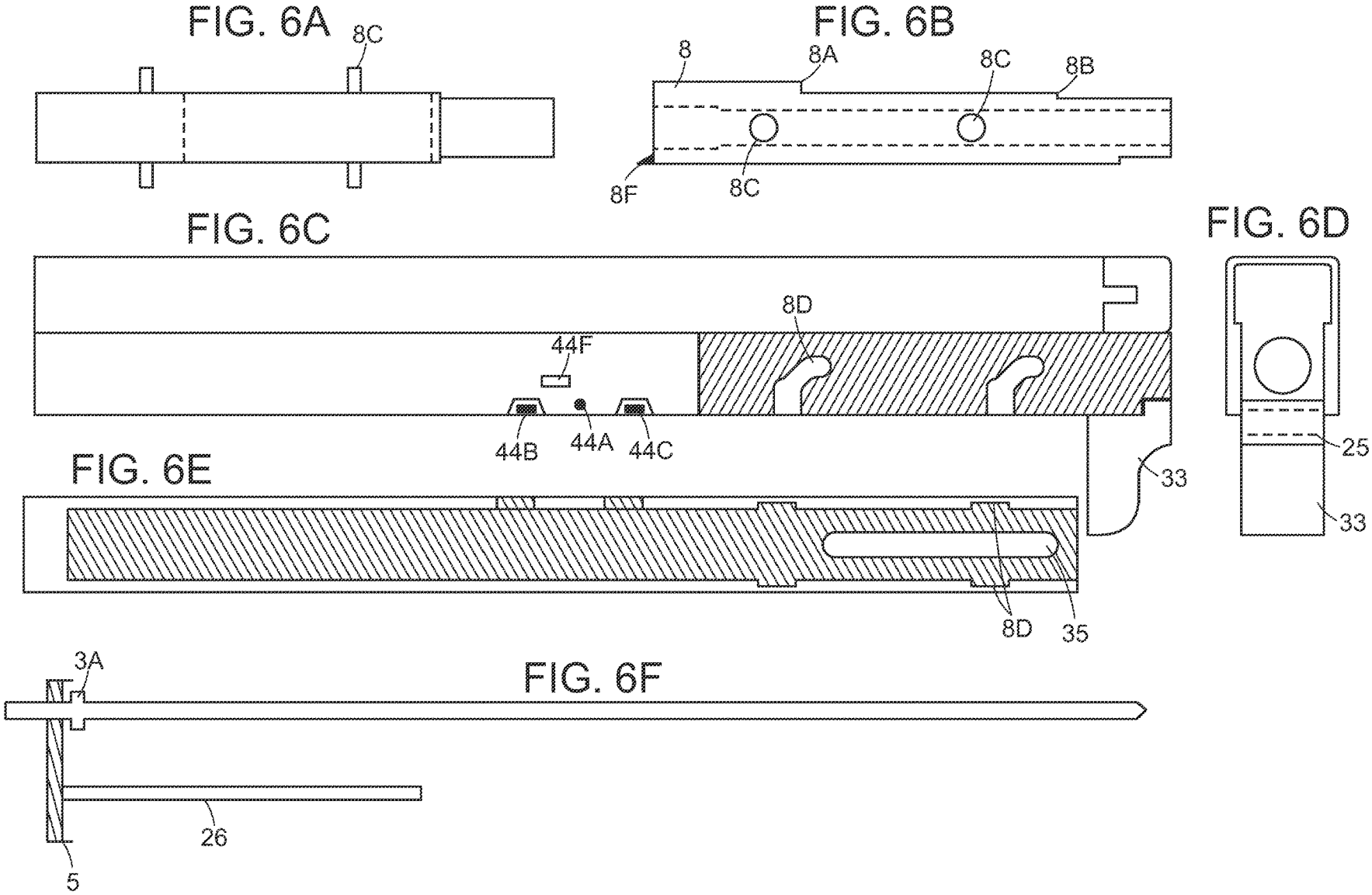
FIG. 6A provides an elevation view of an embodiment of a top of a barrel of the firearm.
FIG. 6B provides a side view of an embodiment of a top of a barrel of the firearm.
FIG. 6C provides partial cutaway view of an embodiment of an inner upper receiver of the firearm.
FIG. 6D provides front view of an embodiment of the barrel and inner upper receiver of the firearm.
FIG. 6E provides a bottom view of an embodiment of the inner upper receiver of the firearm.
FIG. 6F provides a front-view of the bolt an embodiment of inner upper receiver components.
Figures 6G, 6H, 6I, 6J, 7A, 7B, 7C:
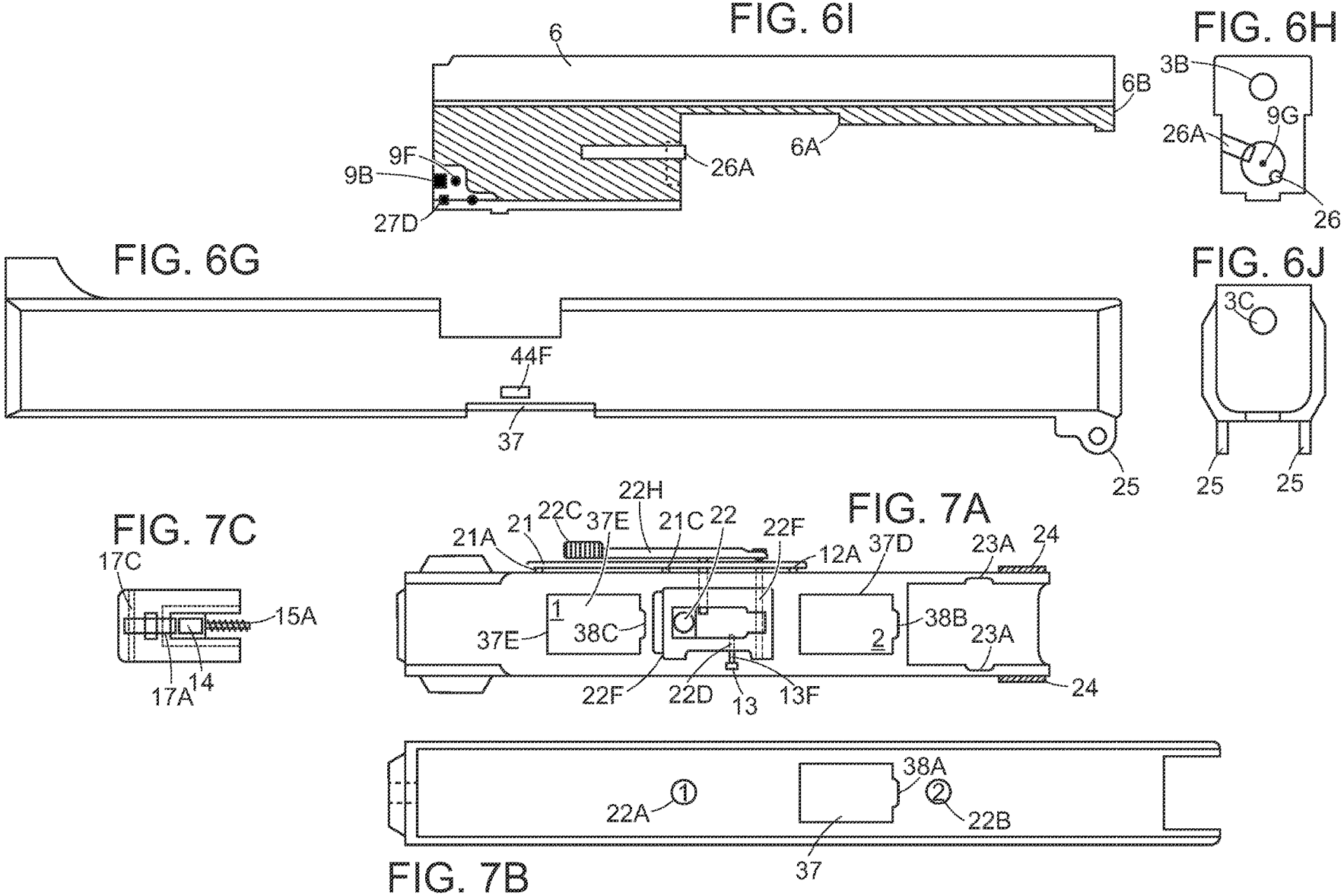
FIG. 6G provides a side view of an embodiment of the outer upper receiver.
FIG. 6H provides a rear view of an embodiment of the outer upper receiver.
FIG. 6I provides a side view of an embodiment of the bolt of the firearm.
FIG. 6J provides a rear view of an embodiment of the bolt of the firearm.
FIG. 7A provides an overhead view of an embodiment of the lower receiver.
FIG. 7B provides an overhead cutaway view of an embodiment of the upper receiver.
FIG. 7C provides an overhead view of trigger housing an embodiment of the lower receiver.
Figure 8B:
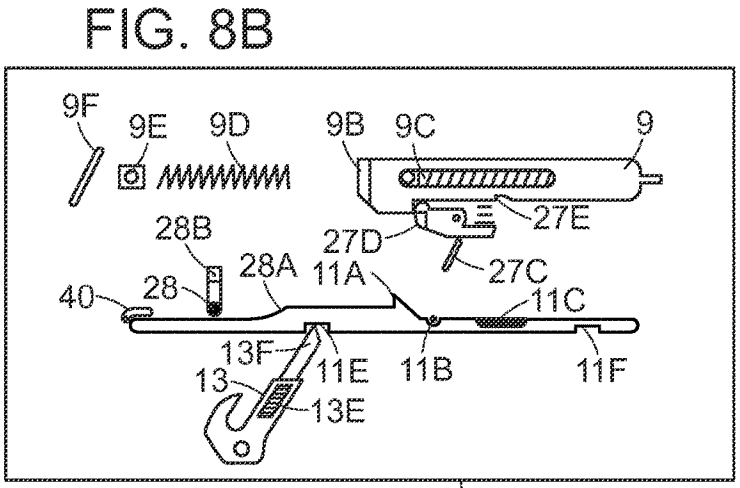
FIG. 8B provides an exploded view of an embodiment of the striker and trigger assembly.
Figure 8A:
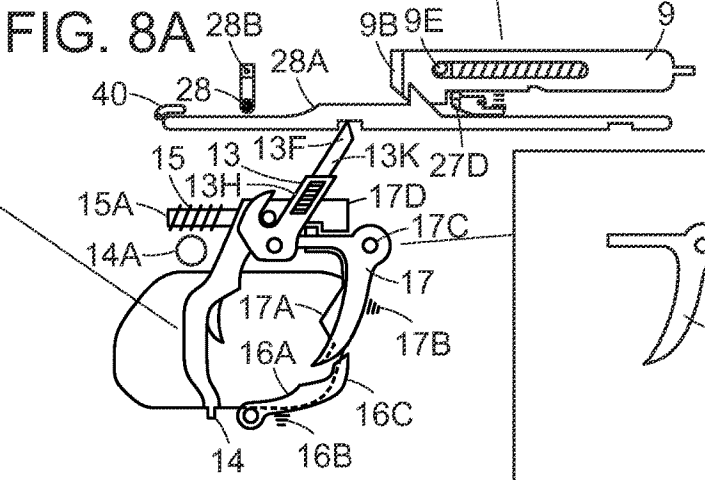
FIG. 8A provides side view of an embodiment of the striker and trigger assembly.
Figure 8D:
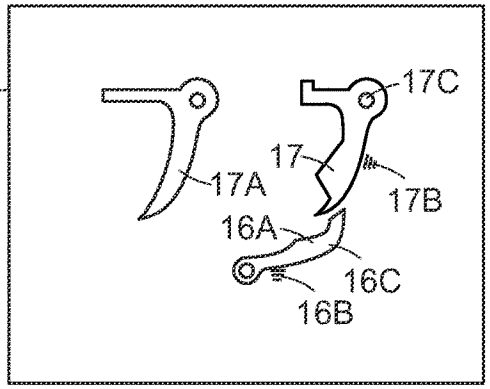
FIG. 8D provides an exploded view of an embodiment of a trigger cocking assembly and mechanism.
Figure 8C:
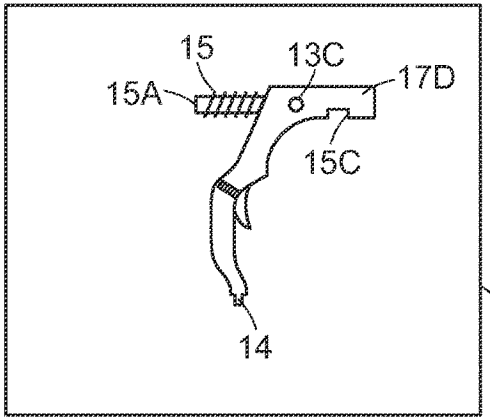
FIG. 8C provides a view of an embodiment of the trigger.
Figure 8E:
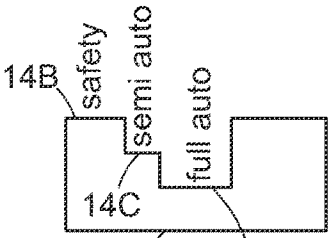
FIG. 8E provides a view of an embodiment of the selector switch to change modes.
Figure 9:
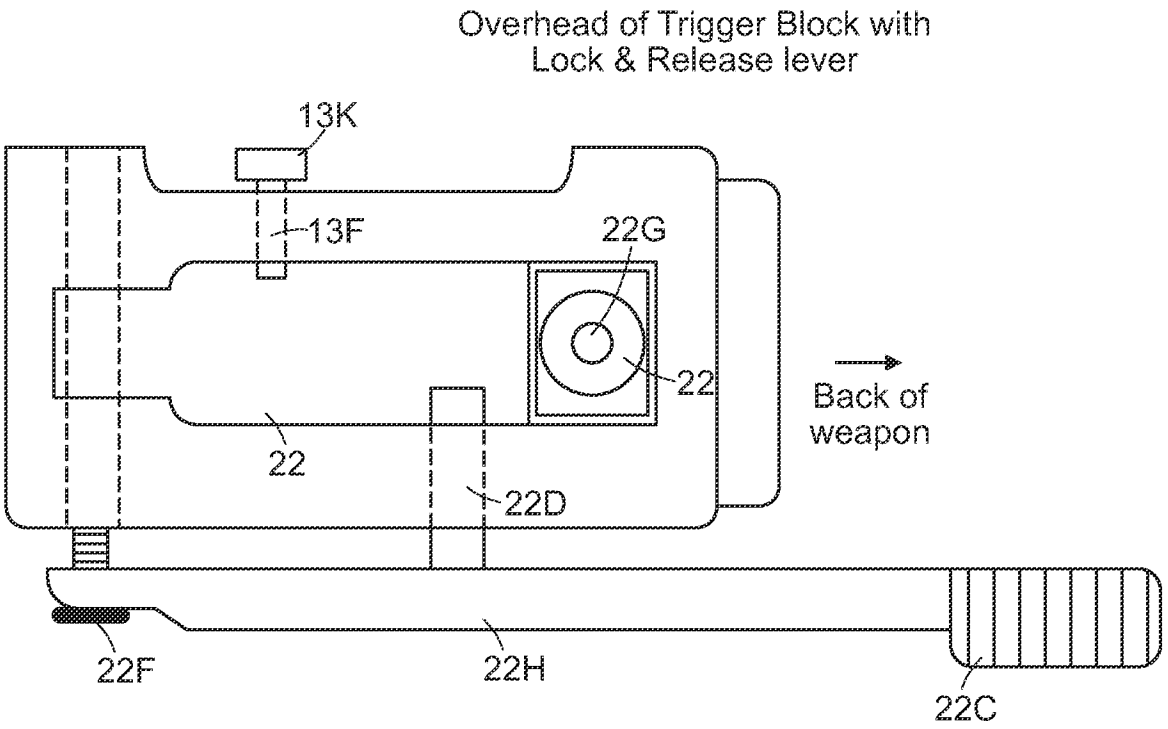
FIG. 9 provides an elevation view of an embodiment of the upper receiver with a locking/release lever and cylinder.
Figure 10A:
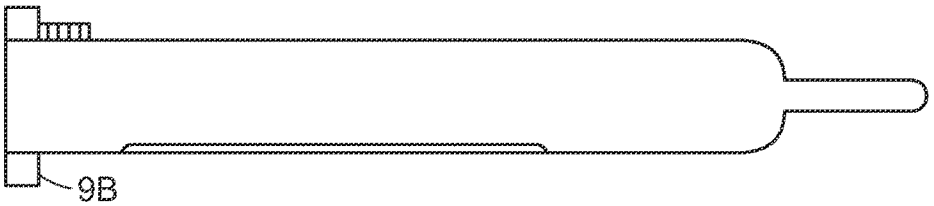
FIG. 10A provides a top view of an embodiment of the striker.
Figure 10B:
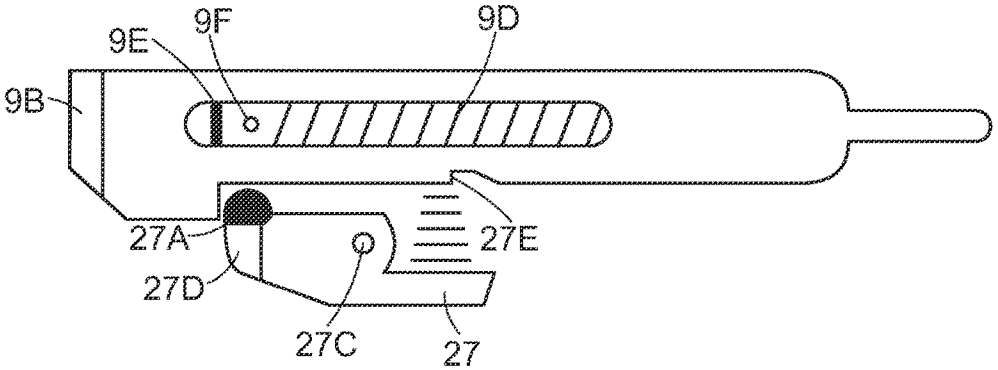
FIG. 10B provides a side view of an embodiment of the striker with safety sear mechanism.
Figure 10D:
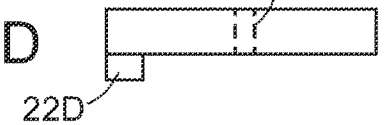
FIG. 10D provides an overhead view of an embodiment of the safety sear.
Figure 10C:
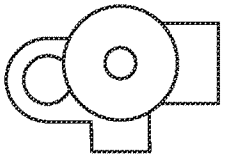
FIG. 10C provides a front view of an embodiment of the striker.
Figure 10E:
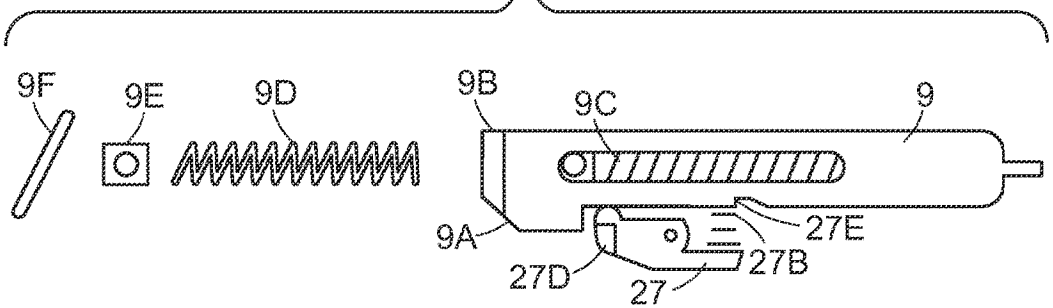
FIG. 10E provides an exploded view of an embodiment of the striker.
Figure 11B:
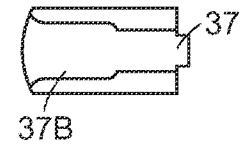
FIG. 11B provides a top view of an embodiment of the magazine.
Figure 11C:
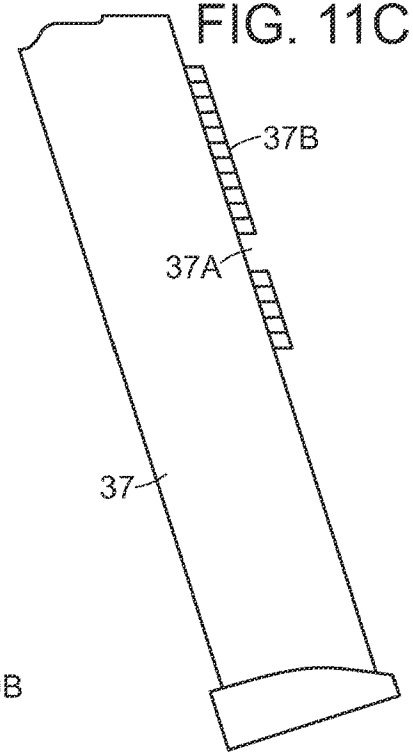
FIG. 11C provides a side view of an embodiment of the magazine.
Figure 11A:
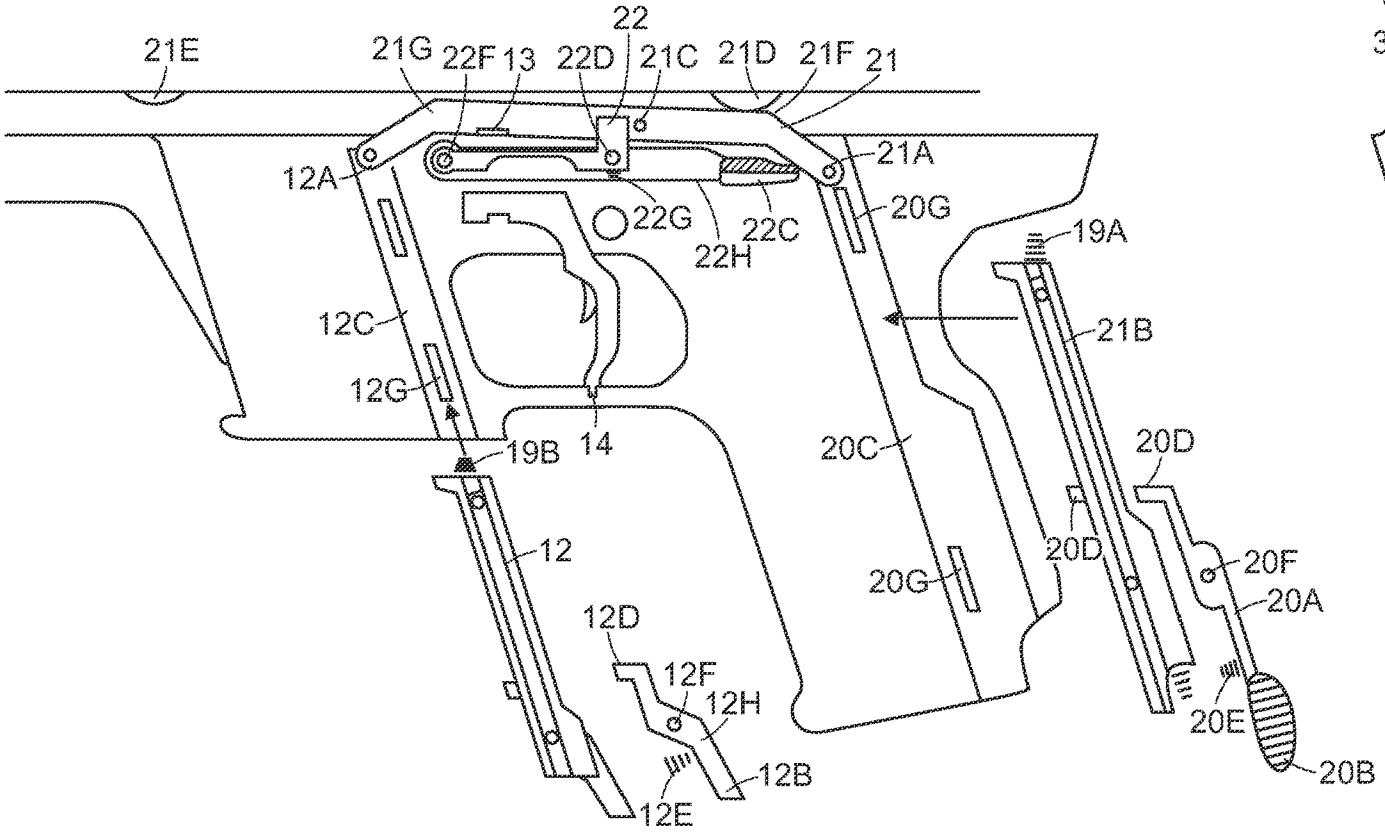
FIG. 11A provides a left hand view of an embodiment of the lower receiver showing an embodiment of the see saw lever and magazine operating rods.
Figure 12A:
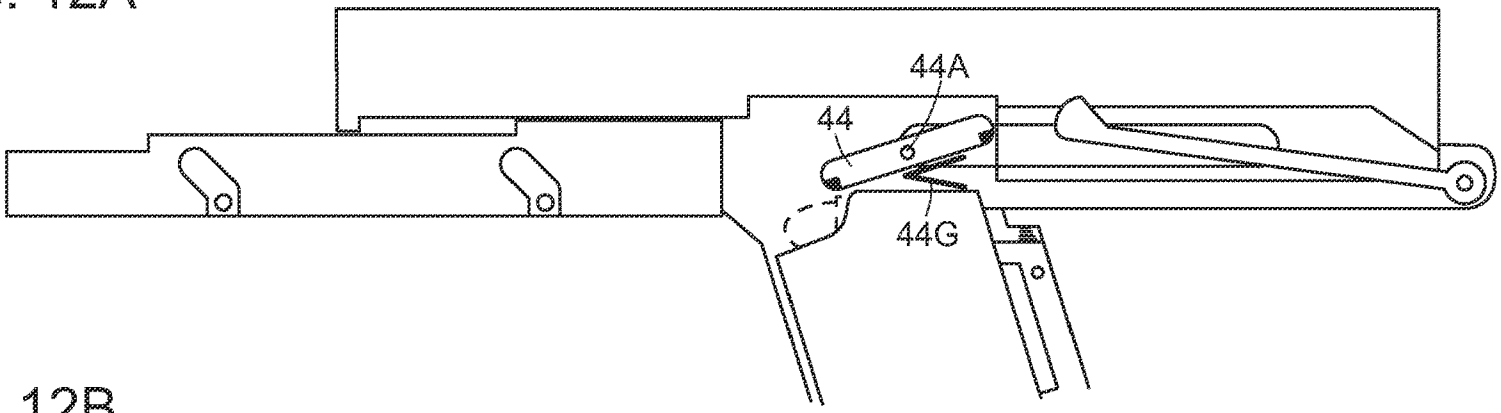
FIG. 12A provides a side view of an embodiment firearm showing operation of a bolt lock lever.
Figure 12B:
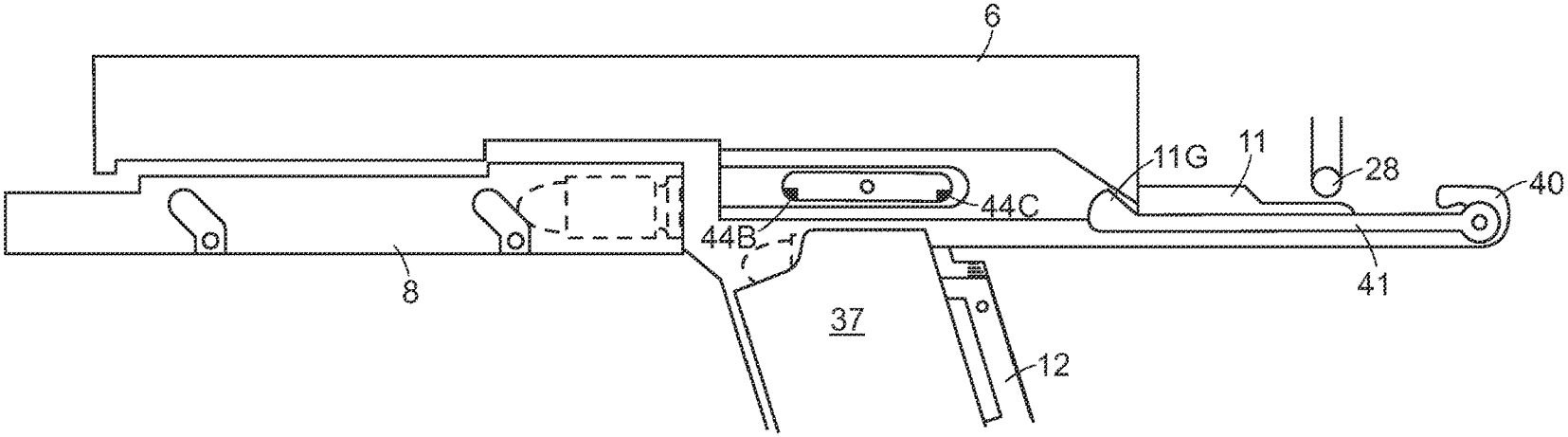
FIG. 12B provides a side view of an embodiment firearm showing operation of a bolt lock lever.

FIG. 2 shows the gun in 'SMG' mode where the gun is being fired from the magazine positioned in front of the pistol ring ("magazine one"). FIG. 3 shows the gun in 'pistol mode' when the gun is being fired from the magazine in the pistol grip ("magazine two"). Movement between SMG and pistol mode is activated by pressing the receiver lock/release lever end 22C downwards. Element 22, the receiver locking/release cylinder has a cylinder at one end and pivots at the other end at connection point 22F. The receiver lock/release lever 22H is pinned at a pivot point to the side of the weapon at 22F. Pivot point 22F is a screwed at one end with a round shaft that goes through the hole which allows it to pivot downwards. A spring 22G keeps the cylinder upwards at all time locking the upper receiver to the lower receiver at locking slot 22A or 22B depending on the configuration. When the receiver lock/release lever 22C is pressed it releases the receiver locking/release cylinder 22 from slot 22A and the upper receive slides backwards on rails formed at guide way 24 on the lower receiver and support handgrip 34 on the upper receiver. A clock spring 23 which is in tension when the gun is in SMG mode in FIG. 2 urges the upper receiver into the pistol mode position. Clock spring 23 is pinned to the upper receiver at connection point 23A. When receiver locking/release cylinder 22 is released, spring 23 recoils by retract spring cable 23B recoiling into spring 23 at the same time pulling the upper receiver backwards because it is pinned to the upper receiver at connection point 23A until the weapon takes the form as shown in FIG. 3 and FIG. 4B which is the "pistol mode." After receiver lock/release lever end 22C is pressed downwards, connection point 22D which is fixed to the receiver lock/release lever 22H is moved downwards while pivoting at pivot point 22F. While the pin 22D which is fixed to receiver lock/release lever 22H moves downwards because it is hovering over the receiver locking/release cylinder 22, as it moves downwards it causes cylinder 22 to move downwards forcing it to release from magazine two pin or block 21A/21B depending on the position.

During the downward motion of the receiver locking/release cylinder 22, trigger level depression point pin 13F which hovers under the cylinder 22 and is fixed to the upper trigger lever 13K at trigger level depression point pin 13F also moves down causing upper trigger lever 13K to collapse into pin 13F and clearing upper trigger lever 13K from trigger lever rod slots 11E/11F allowing the upper receiver to fully disengage and transform backwards due to spring loaded tension caused by receiver retract spring 23 or to transform forward when 22C is depressed while the upper receiver is manually pushed forward back into SMG position. Upper trigger lever 13K then reconnects with trigger operating rod 11 at trigger lever rod slot one 11E or trigger lever rod slot two 11F depending on the position to assume the first or second firing position using the same trigger 14. Simultaneously during this backward motion to pistol mode, the upper receiver see saw rod suppressor 21D moves from point one 21F so that upper see saw rod suppression point 21E is directly over see saw rod suppression point two 21G causing spring 19B to become relaxed and compression at spring 19A. Upper receiver magazine well 37 is now positioned over lower receiver magazine well two 37E. Because see saw lever 21 is pinned to magazine two operating block 21B at pin 21A magazine, engaged with the magazine two operating block 21B, is forced up into the firing position when magazine two catch 20D catches the magazine and at magazine catch slot 37A. Magazine two operating block 21B operates and contact the magazine two guide way 20C through dowels and the magazine operating bar guide rail 20G. The pistol grip magazine (magazine two) is operated by the catch lever 20A and can be released from the well by pressing the magazine catch release button 20B which compresses magazine two catch spring 20E causing magazine two catch 20D to move backwards out of magazine catch slot 37A. Catch lever 20A is pinned at 20F which allow it to pivot.

To move from position one (the 'SMG' mode as in FIG. 2) to position two ('pistol' mode as in FIG. 3) lever contact point 22C is pressed. However, to move from pistol mode, position two, to SMG mode, position one, the user depresses receiver lock/release lever contact point 22C and also manually pushes the upper receiver forward back to position one.

The trigger of the S-T Transformer is made up of three major components, trigger 14 trigger operating lever 13 and the trigger operating rod 11. The trigger 14 can be described as a flat or pull back trigger that runs on a rod 15A which is tensioned by spring 15. Both spring 15 and rod 15A are operated in the housing 15B which allows the trigger to move forward and backward. When pressure is applied to the trigger 14 it moves backwards, this in turn pulls 13 backwards. Lever 13 is pinned at point 13C and the backwards movement of the trigger 14 causes it to pivot at the lever pin 13A which is fixed to trigger 14 forcing lever 13 to move backwards. Lever 13 is connected to trigger operating rod 11 via trigger lever rod slots 11F or 11E depending on upper receiver position. Lever 13 is made in two portions, upper and lower. Upper trigger lever 13K is made to move up and down freely in lower trigger lever 13H. A spring 13E supplies force to keep upper trigger lever 13K upwards. The spring 13E sits in a slot 13G in the lower portion. 13F is a pin that hovers under locking/release cylinder 22 that allows the upper portion to be depressed in the lower portion when 22B pressed down allowing locking/release cylinder 22 and lower trigger lever 13H to release the upper receiver. Upper trigger lever 13K is depressed into pin 13F during the backward pull of the trigger as it rotates at 13C.

The lever 13 moves backwards and main sear 11A contacts the striker 9 at 9B, the striker 9 travels backwards until disconnector contact point 28A makes contact with disconnector 28. The disconnector 28 then suppresses trigger operating rod 11 downwards disconnecting the striker 9 while disconnector 28 travels upwards in disconnector slot 28B which resets disconnector 28 for the next cycle. Simultaneously, safety sear disconnect two 11C suppresses safety sear 27 thus causing striker 9 to travel fully forward, igniting a primer. The bolt 6 cycles and right before the end of this process it contacts full auto rod 41. Full auto rod 41 acts as the disconnector when the weapon is in semi-automatic (burst) and fully automatic mode. As bolt 6 closes it makes contact at 11G allowing trigger operating rod 11 to be disconnected from striker 9 and firing the weapon during each cycle. Trigger operating rod 11 jumps upwards due to spring tension and when the bolt cycles forward, safety sear disconnect two 11C catches the striker engagement surface 9B and bolt 6 travels forward to into battery. Prior to the bolt 6 closing, it catches full auto rod 41 and moves it forward thus releasing disconnector 28 for a next cycle. The striker 9 is left cocked and ready to fire a next round. This completes the double action firing cycle.

At the first press of the trigger 14 the weapon is designed to fire from this double action mode. However, after the first press, single action mode will be automatically activated unless decommissioned by the user. In single action mode trigger 14 is held right before the breaking point where disconnector contact point 28A contacts disconnector 28. The cocking lever 17A is designed to automatically move upwards due to spring tension from 17B and holds trigger 14 in place at trigger cocking contact point 17D. This is described as single action because when the trigger is pressed it breaks immediately and causes the weapon to discharge. This mode can be decommissioned by pressing cocking lever 17A until it locks at trigger cocking release 16 via points 16C. It can also be recommissioned by pressing trigger cocking release 16 at catch 16A. Trigger cocking release 16 has a constant upward force applied by spring 16B. The trigger 14 can also be used to cock the weapon before the weapon is fired by the push button selector switch 14A to the safety mode 14B. At this point trigger 14 will be blocked right before the breaking point of the weapon which will activate the cocking lever 17A to hold trigger 14 right before the breaking point. When safety 14B is decommissioned the weapon will remain in single action mode unless it is decommissioned by the user by pressing trigger cocking release 16 at 16A Another feature of the disclosed invention is the trigger lock safety 17, which is made to manually lock trigger 14 when it is at rest at the user desires. Trigger lock safety 17 locks in place at trigger locking slot 15C and can be decommissioned by once again pressing trigger lock safety 17 forward it until it makes contact with trigger cocking release 16 at contact point 16C. Both trigger lock safety 17 and cocking lever 17A are pinned together by trigger cocking lever pin 17C. Trigger lock safety 17 is positioned inside of cocking lever 17A, however both features operate independent of each other. Both features are also decommissioned and recommissioned by the same trigger cocking release 16, independent of each other. Trigger lock safety and cocking lever 17,17A and trigger cocking release 16 are all designed to fall within the trigger ring which gives the user ease of operation and ambidextrousness. Another safety feature is controlled by push button selector switch 14A. 14A has three different options, first position is safety 14B, second position is semi auto 14C and third is fully auto 14D. This feature blocks or stops the trigger 14 from traveling further than the user intends it to. Thus the trigger 14 can be locked for safety or the weapon can be made to fire in full auto by allowing trigger 14 to travel backwards in that depression.

The firearm disclosed herein is designed with a safety feature mainly for decoking the weapon when in single action mode. It also prevents accidental discharge when the weapon is being transformed or moved between position one to position two when receiver lock/release lever 22C is pressed. The safety sear 27 is pinned inside the bolt directly below the striker 9 at the end of the bolt 6. The striker 9 is made up of a spring 9D that sits in a channel inside the striker 9C this 9D is designed to generate enough kinetic energy to discharge a conventional round. 9D is held inside the striker by a retainer plate 9E. Retainer plate 9E is pinned to the bolt 6 through pin 9F that sits in a channel inside the bolt 6 at striker retainer pin housing 10. Safety sear 27 is pinned to the bolt at 27C and is under constant spring tension from sear spring 27B. The safety sear disconnect 11C makes contact with sear disengagement lip 27D causing safety sear 27 to be depressed. The disengagement contact surface 27A is fully depressed thus releasing safety sear 27 from cocking notch 27E and also depresses safety sear 27 enough to clear the lip at safety stopping lip 9A. At the same time, disconnector 28 is making contact with 28A which releases striker 9 thus allowing the striker 9 to move fully forward, contacting the primer in the bullet.

The safety feature is also relevant when the weapon is being decocked or being taken out of single action mode. During this action, sear disengagement contact surface 27A is positioned inside cocking notch 27E and cocking lever 17A is positioned at trigger cocking contact point 17D thus holding the gun cocked or in single action mode. If the user wishes to decommission single mode or uncock the weapon, first cocking lever 17A has to be pressed to make contact with trigger cocking release 16, releasing it from trigger cocking contact point 17D, and thus moving trigger 14 forward automatically. Because trigger 14 is connected to trigger operating lever 13, and trigger operating lever is 13 connected to trigger operating rod 11 at 11E or 11F, when trigger 14 is uncocked, trigger operating rod 11 moves forward. During this forward motion, decocking disconnect one 11B is designed to make contact with disengagement contact surface 27A thus releasing it enough to clear cocking notch 27E. Striker 9 starts moving forward back to its resting position inside of bolt 6. This is the same action that the striker 9 does before the weapon is discharged however it is blocked from contacting the primer via safety stopping lip 9A that makes contact with safety sear 27 at disengagement contact surface 27A a few millimeters prior to contacting the primer, and thus the weapon will not be discharged. Only safety sear disconnect two 11C creates enough downwards movement in safety sear 27 to fully clear the way of the striker 9 to discharge the weapon and this is only possible when disengagement contact surface 27A makes contact with cocking notch 27E and disconnector contact point 28A meets disconnector 28, or if trigger 14 is squeezed to breaking point. This feature works in the same way when the weapon is cocked and is being transformed between position one and position two hence preventing accidental discharge.

The weapon is also designed to fire in semi-automatic mode and full automatic mode using the selector switch 39 which allows the trigger to move further backwards thus allowing operating lever 13 to engage full auto sear 40.

The bolt locking system is used to hold the bolt open when one magazine is fired until it is empty or when it is released from the magazine well. Bolt lock lever 44 is positioned on the outside in a slot of the upper inner receiver and protrudes inside the weapon at bolt locking magazine contact point 44B and bolt catch point 44C. Bolt locking magazine contact point 44B is designed to contact the magazine and levels out bolt lever lock 44 which is spring tensioned through 44G which constantly positions the lever to catch the bolt 6 at bolt catch point 6B. Bolt lock lever 44 is also pined at bolt lock pin 44A which allows bolt lever lock 44 to pivot upwards and downwards. Hence when the magazine is released or the magazine is fired until empty, the follower protrudes at the top of the magazine and makes contact with bolt lock lever 44 at bolt locking magazine contact point 44B. When the magazine is released, bolt lock lever 44 takes control of holding the bolt 6 because it is constantly under spring tension from bolt lever spring 44G forcing bolt catch point 44C to make contact with catch point 6B. When a loaded magazine is loaded into the magazine well, it makes contact with bolt lock lever 44 at contact point 44B and levels the lever 44 thus allowing the bolt 6 to move forward, chambering a round. This is the auto chamber feature of the weapon. Also, if any of the two magazines are fired until empty, the follower holds the bolt open. However whenever receiver locking/release cylinder 22 is pressed and the weapon transforms into pistol mode, bolt lock lever 44 takes control of holding the bolt open because magazine one is dragged out of the well. Due to the operation of see saw lever 21 and magazine one operating block 12, when magazine two is loaded, it will now be forced into the upper magazine well 37 thus suppressing bolt lock magazine contact point 44B once again allowing the bolt 6 to move forward and automatically loading a round. This feature is auto chambering between position one and two. The bolt 6 is designed to automatically remain open to auto chamber a round, however this feature can be manually decommissioned by pressing the bolt release lock 44F which closes the bolt preventing auto chambering. This levels out the lever allowing the bolt to close. The weapon can then be loaded on a closed bolt without auto chambering a round. This feature works like a slide release knob on a typical hand gun when the slide is cocked.

In one embodiment, the barrel is designed to be a max length of 5.5 inches with a total weapon length of 13 inches. Of course, these sizes may vary depending on embodiment.

A list of the transformer sub-pistol parts as discussed herein is provided in Table 1 below:

TABLE 1

| | |
|---|---|
| 1 | Front sight |
| 2 | Rear sight |
| 3 | Recoil rod |
| 3A. | Recoil spring stop ridge |
| 3B. | Upper receiver lock pin |
| 3C | Receiver locking well |
| 3D | Upper receiver slide port |
| 4 | Recoil spring |
| 5 | Recoil and ejector rod retaining plate |
| 6 | Bolt |
| 6A | Bolt Charging Slot |
| 6B | Bolt Catch point |
| 7 | Ambidextrous Charging angle |
| 7A | Detachable charging attachment/Picatinny rail system |
| 8 | Barrel |
| 8A/B | Barrel front delay locking system |
| 8C | Barrel camel dowel |
| 8D | Barrel delay locking grove |
| 8F | Barrel feed ramp |
| 9 | Striker |
| 9A | Safety stopping lip |

TABLE 1-continued

| | |
|---|---|
| 9B | Striker/operating rod engagement surface |
| 9C | Striker spring channel |
| 9D | striker spring |
| 9E | Striker spring retainer |
| 9F | Spring retaining pin |
| 10 | Striker retainer pin housing |
| 11 | Trigger operating rod |
| 11A | Main Sear |
| 11B | Decocking/Safety sear Disconnect 1 |
| 11C | Safety sear disconnect 2 |
| 11E | Trigger lever rod slot 1 |
| 11F | Trigger lever rod slot 2 |
| 11G | Auto Sear Contact point |
| 12 | Magazine 1 operating block |
| 12A | Mag 1 seesaw connection lever/Mag 2 operating block |
| 12B | Mag 1 catch release button |
| 12C | Mag 1 guide way |
| 12D | Magazine 1 catch |
| 12E | Magazine 1 catch spring |
| 12F | Magazine 1 catch pin |
| 12G | Magazine 1 operating bar guide rail |
| 12H | Magazine 1 catch contact |
| 13 | Trigger operating leaver |
| 13A | Trigger lever pin |
| 13C | Trigger lever pivot point |
| 13E | Trigger lever spring |
| 13F | Trigger lever depression pin point |
| 13G | Trigger lever depression slot |
| 13H | Lower Trigger lever |
| 13K | Upper trigger lever |
| 14 | Trigger |
| 14A | Push button selector switch |
| 14B | Push button selector switch safety position |
| 14C | Push button selector switch semi-automatic position |
| 14D | Push button selector switch fully automatic position |
| 15 | Trigger spring |
| 15A | Trigger Spring guide rod |
| 15C | Trigger locking slot |
| 16 | Trigger/trigger cocking release |
| 16A | Trigger locking/cocking catch |
| 16B | Trigger lock spring |
| 16C | Trigger locking/trigger cocking contact point |
| 17 | Trigger lock safety |
| 17A | Cocking lever |
| 17B | Trigger locking/cocking spring |
| 17C | Trigger dead lock lever/cocking lever pin |
| 17D | Trigger cocking contact point |
| 19A | Magazine 2 operating block spring |
| 19B | Magazine 1 operating block spring |
| 20A | Magazine 2 catch lever |
| 20B | Magazine 2 catch release button |
| 20C | Magazine 2 guide way |
| 20D | Magazine 2 catch |
| 20E | Magazine 2 catch spring |
| 20F | Magazine 2 catch pin |
| 20G | Magazine operating bar guide rail |
| 21 | Magazine see saw lever |
| 21A | Magazine 2 seesaw connecting lever/magazine operating block pin |
| 21B | Magazine 2 operating block |
| 21C | See saw pivot pin |
| 21D | Upper receiver see saw rod suppressor 1 |
| 21E | Upper receiver see saw rod suppressor 2 |
| 21F | See saw rod suppression point 1 |
| 21G | See saw rod suppression point 2 |
| 22 | Receiver locking/release cylinder |
| 22A | Receiver locking slot 1 |
| 22B | Receiver locking slot 2 |
| 22C | Receiver lock/release lever contact point |
| 22D | Lever and cylinder connection point |
| 22F | Receiver lock/release lever pivot point |
| 22G | Cylinder spring |
| 22H | Receiver lock/release lever |
| 23 | Receiver retract spring |
| 23A | Retract spring connection point |
| 23B | Retract spring cable |
| 24 | Receiver guide way |
| 25 | Receiver pivot pin |
| 25A | Receiver pivot block |
| 26 | Ejector rod |

TABLE 1-continued

| | |
|---|---|
| 26A | extractor |
| 27 | Safety Sear |
| 27A | Sear disengagement contact surface |
| 27B | Sear spring |
| 27C | Safety sear pin |
| 27D | Sear disengagement lip X |
| 27E | Cocking notch |
| 28 | Disconnector |
| 28A | Disconnector contact point |
| 28B | Disconnector slot |
| 29A | Charging angle non-reciprocating locking trigger |
| 29B | Charging angle spring |
| 30 | Dovetail grove |
| 31 | Charging angle housing and pin |
| 32 | Ejection port/Breech |
| 33 | Finger Guard |
| 33A | Hand guard with guide rail |
| 34 | Forward handgrip |
| 35 | Charging angle connection slot |
| 35A | Charging angle contact ridge |
| 36 | Ambidextrous charging attachment |
| 37 | upper receiver Magazine well |
| 37A | magazine catch slot |
| 37B | Magazine ridge |
| 37D | Lower receiver magazine well 1 |
| 37E | Lower receiver magazine well 2 |
| 38A | Upper receiver feed ramp indent |
| 38B | Lower receiver feed ramp indent 1 |
| 38C | Lower receiver feed ramp indent 2 |
| 40 | Full Auto Sear |
| 41 | Full auto rod |
| 42 | Butt Stock |
| 43 | Butt Stock catch |
| 44 | Bolt lock lever |
| 44A | Bolt lock pin/pin point |
| 44B | Bolt lock mag contact point |
| 44C | Bolt catch point |
| 44F | Manual Bolt lock release |
| 44G | Bolt lever spring. |
| 100 | Upper Receiver |
| 200 | Lower Receiver |
| 300 | Magazine One |
| 400 | Magazine Two |

While several variations of the present disclosure have been illustrated by way of example in preferred or particular embodiments, it is apparent that further embodiments could be developed within the spirit and scope of the present disclosure, or the novel concept thereof. However, it is to be expressly understood that such modifications and adaptations are within the spirit and scope of the present disclosure, and are inclusive, but not limited to the following appended claims as set forth.

What is claimed is:

1. A firearm comprising:

a lower receiver;

an upper receiver, the upper receiver connected to the lower receiver and slideably movable relative to the lower receiver;

a magazine well defined by the lower receiver, a first magazine held within the magazine slot;

a pistol grip on the lower receiver, the pistol grip housing a second magazine;

the upper receiver movable between a submachine gun firing mode having the upper receiver engaged with and capable of firing from the first magazine, to a pistol mode having the upper receiver engaged with and capable of firing from the second magazine.

2. The firearm of claim 1 further wherein the first magazine is engaged with a first magazine operating block which is slideably movable between an engaged and disengaged position, and wherein the second magazine is engaged with a second magazine operating block which is slideably movable between an engaged and disengaged position.

3. The firearm of claim 2 further comprising a see saw lever engaged with the first magazine block and second magazine block, the see saw lever connected to the first magazine operating block at a first end, and connected to the second operating block at a second end, the see saw lever operable, in a first mode, to move the first magazine operating block to the engaged position and at the same time move the second magazine operating block to the disengaged position and operable, in a second mode to move the second magazine operating block to the engaged position and at the same time move the first magazine operating block to the disengaged position.

4. The firearm of claim 3 wherein the upper receiver comprises a protruding suppressor engagable with a top of the see saw lever during a sliding motion of the upper receiver along the lower receiver.

5. The firearm of claim 1 wherein the upper receiver is securable in position relative to the lower receiver using a locking release cylinder, the locking release cylinder being attached to one of the upper receiver or lower receiver and engageable with a first locking slot on the other of the upper receiver or lower receiver to hold the upper receiver in the submachine gun mode, and engagable with a second locking slot on the other of the upper receiver or lower receiver to hold the upper receiver in the pistol mode.

6. The firearm of claim 5 further comprising a locking release lever engaged with the locking release cylinder, the locking release cylinder biased in an extended position by a spring, and movable against the spring by a movement of the locking release lever, the locking release lever extending from one of the upper receiver or lower receiver.

7. The firearm of claim 6 further comprising a spring engaged with the upper receiver and lower receiver, the spring biased to apply force to automatically draw the upper receiver from the submachine gun mode to the pistol mode when the locking release cylinder is released from the first locking slot.

8. The firearm of claim 1 further comprising a striker in the upper receiver, the striker operable to contact a cartridge to initiate firing, and further comprising a safety sear, the safety sear having a contact surface engagable with one or more lips on the striker and when engaged, preventing a firing motion of the striker, the safety sear pivotally movable about a connection and having a spring opposite to the contact surface urging the contact surface towards the striker holding the contact surface engaged with the striker at rest, the safety sear operable to prevent unintentional motion of the striker when moving between the submachine gun mode and pistol mode, upon a pulling of the trigger, the safety sear is disengaged with the striker.

9. The firearm of claim 8 wherein the one or more lips on the striker comprises a cocking notch and a safety lip, the cocking notch ahead of the safety lip.

10. The firearm of claim 8 wherein the safety sear is pivotally connected to a bolt within the upper receiver.

11. The firearm of claim 1 wherein the upper receiver further comprises a trigger operating rod, the trigger operating rod movable with the upper receiver relative to the lower receiver, the trigger operating rod engagable with a trigger assembly both when the upper receiver is in the submachine gun mode and in the pistol mode.

12. The firearm of claim 11 wherein the trigger operating rod comprises a first slot to engage with the trigger assembly when the upper receiver is in the submachine gun mode, and comprises a second slot to engage with the trigger assembly when the upper receiver is in the pistol mode.

13. The firearm of claim 8 wherein the upper receiver further comprises a trigger operating rod, the trigger operating rod movable with the upper receiver relative to the lower receiver, the trigger operating rod engagable with a trigger assembly both when the upper receiver is in the submachine gun mode and in the pistol mode, the trigger operating rod comprising a safety sear disconnect surface to pivot the safety sear to release the safety sear contact surface from the striker upon a movement of the trigger operating rod caused by the trigger assembly.

14. The firearm of claim 1 wherein the upper receiver comprises a bolt and a bolt lock lever under a spring tension, the bolt lock lever operable such that, upon the urging of a loaded magazine into the magazine well which contacts the bolt lock lever, the bolt lock lever is moved, allowing the bolt to automatically chamber a round from the magazine.

15. The firearm of claim 1 wherein a bolt of the upper receiver remains open as the upper receiver moves from the submachine gun mode to the pistol mode, the open bolt is operable to automatically load a round from the second magazine as it moves to the pistol mode.

16. The firearm of claim 1 further comprising a trigger safety, the trigger safety engaged with the trigger assembly and preventing a pulling of the trigger in a locked position, and allowing a pulling of the trigger in an unlocked position, the trigger safety comprising a lever within a trigger ring of the lower receiver.

17. The firearm of claim 16 wherein the trigger safety further comprises a pivotal connection to the lower receiver allowing a pivoting movement, wherein a distal end of the trigger safety is urged upward by a spring into engagement with a trigger locking slot of the trigger in the locked position, preventing the pulling of the trigger.

18. The firearm of claim 17 further comprising a trigger cocking release lever, the trigger cocking release lever pivotally attached at its proximal end to the trigger ring and having a distal end urged upwardly by a spring, the distal end of the trigger cocking release sized to engaged with a proximal end of the trigger safety, wherein a first movement of the proximal end of the trigger safety causes the distal end of the trigger safety to disengage from the trigger locking slot, the distal end of the trigger cocking release lever engaging with the proximal end of the trigger safety and blocking the proximal end from moving opposite to the first movement.

19. The firearm of claim 18 where the trigger cocking release lever is released from engagement with the proximal end of the trigger safety by a pushing of the lever, clearing the distal end away from the proximal end of the trigger safety, and causing the proximal end of the trigger safety to return to a rest position as urged by a spring and in turn causing the distal end of the trigger safety to engage with the trigger locking slot of the trigger.

20. The firearm of claim 18 further comprising a safety having an active mode and a decommissioned mode, and wherein the upper receiver further comprises a trigger operating rod engaged with the trigger, wherein the trigger is operable to cock the firearm by being moved to a cocked position positioning the trigger operating rod to be drawn back until just before a breaking point, the safety preventing movement of the trigger operating rod past the breaking point, a distal end of the trigger cocking release lever engaging with the trigger when the trigger is in the cocked position, and holding it in the cocked position until the trigger is moved from the cocked position.

* * * * *